US007867427B2

(12) United States Patent
Chrystal et al.

(10) Patent No.: US 7,867,427 B2
(45) Date of Patent: Jan. 11, 2011

(54) METHOD OF HARD COATING A SURFACE WITH CARBIDE

(75) Inventors: Lorne Chrystal, Edmonton (CA); Andrew K Duncan, Edmonton (CA)

(73) Assignee: Hunting Energy Services (Drilling Tools) Ltd., Calgary (CA)

( * ) Notice: Subject to any disclaimer, the term of this patent is extended or adjusted under 35 U.S.C. 154(b) by 707 days.

(21) Appl. No.: 11/432,640

(22) Filed: May 11, 2006

(65) Prior Publication Data

US 2007/0000598 A1 Jan. 4, 2007

(30) Foreign Application Priority Data

Jun. 29, 2005 (CA) ..... 2511309

(51) Int. Cl.
*B28B 1/14* (2006.01)

(52) U.S. Cl. ..... 264/299; 264/239

(58) Field of Classification Search ..... 264/165, 264/212, 298, 299, 108, 109, 112, 114; 419/14
See application file for complete search history.

(56) References Cited

U.S. PATENT DOCUMENTS 3,941,181 A * 3/1976 Stoody ..... 164/59.1
4,017,480 A * 4/1977 Baum ..... 428/601
4,719,076 A * 1/1988 Geczy et al. ..... 419/8
4,720,199 A 1/1988 Geczy et al.
5,114,772 A * 5/1992 Vives et al. ..... 428/49
5,901,170 A * 5/1999 Peysakhovich et al. ..... 373/155
6,220,117 B1 4/2001 Butcher
6,554,054 B2 * 4/2003 Noble ..... 164/114
6,571,493 B2 6/2003 Amano
6,575,075 B2 * 6/2003 Cohen ..... 89/36.02
6,581,671 B2 6/2003 Bucher et al.
2003/0167910 A1 * 9/2003 Strait ..... 89/36.02
2004/0020353 A1 * 2/2004 Ravid et al. ..... 89/36.02

* cited by examiner

*Primary Examiner*—Christina Johnson
*Assistant Examiner*—Elizabeth Royston
(74) *Attorney, Agent, or Firm*—Christensen O'Connor Johnson Kindness PLLC

(57) ABSTRACT

A method of hard coating a surface with carbide. A first step involves positioning a temporary membrane a pre-selected distance from a surface of a work piece to be hard coated to create a insertion gap which is accessible from an upper end. A second step involves filling the insertion gap with carbide pieces, sized to fit the insertion gap in a selected orientation, by inserting the carbide pieces from the upper end of the insertion gap and allowing them to drop into the insertion gap by force of gravity. A third step involves filling spaces between the carbide pieces with bonding powder by inserting the bonding powder into the upper end of the insertion gap. A fourth step involves heating the powder until the carbide pieces are bonded to the surface. A fifth step involves removing the temporary membrane.

12 Claims, 8 Drawing Sheets

METHOD OF HARD COATING A SURFACE WITH CARBIDE

FIELD OF THE INVENTION

The present invention relates to method of hard coating a surface with carbide, and a work piece that has been hard coated in accordance with the teachings of the method.

BACKGROUND OF THE INVENTION

The hard coating method currently used involves individually mounting carbide pieces onto a surface of a work piece one at a time. Using this method one can effectively cover up to seventy percent of the surface with carbide.

SUMMARY OF THE INVENTION

According to the present invention there is provided a method of hard coating a surface with carbide. A first step involves positioning a temporary membrane a pre-selected distance from a surface of a work piece to be hard coated to create an insertion gap that is accessible from an upper end. A second step involves filling the insertion gap with carbide pieces, sized to fit the insertion gap in a selected orientation, by inserting the carbide pieces from the upper end of the insertion gap and allowing them to drop into the insertion gap by force of gravity. A third step involves filling spaces between the carbide pieces with bonding powder by inserting the bonding powder into the upper end of the insertion gap. A fourth step involves heating the powder until the carbide pieces are bonded to the surface. A fifth step involves removing the temporary membrane.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

A preferred method of hard coating a surface 10 with carbide will now be described with reference to FIG. 1 through 14.

Figure 1:
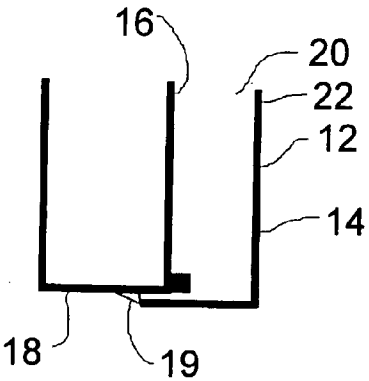
FIG. 1 is a side plan view in section of a sleeve secured to a surface to be hard coated forming an insertion gap.
Figure 2:
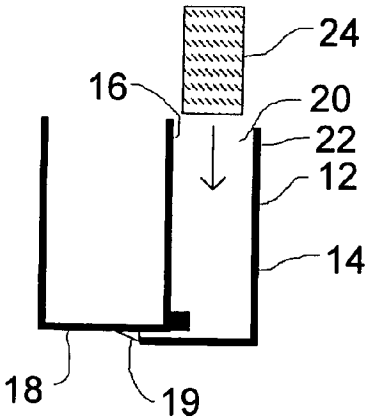
FIG. 2 is a side plan view in section of the insertion gap being filled with carbide pieces
Figure 3:
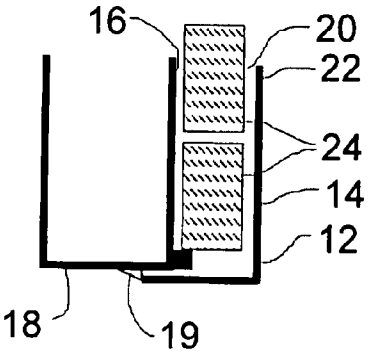
FIG. 3 is a side plan view of the insertion gap filled with carbide pieces.
Figure 4:
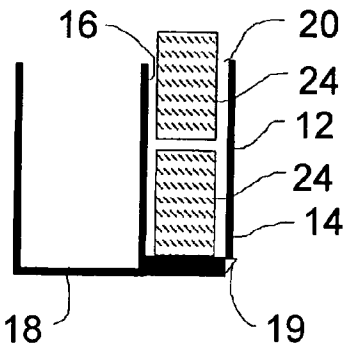
FIG. 4 is a side plan view of an alternate method of securing sleeve to the surface to be hard coated.
Figure 5:
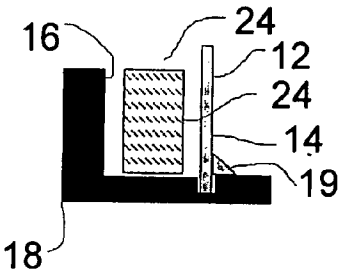
FIG. 5 is a side plan view of an alternate method of securing sleeve to the surface to be hard coated.
Figure 6:
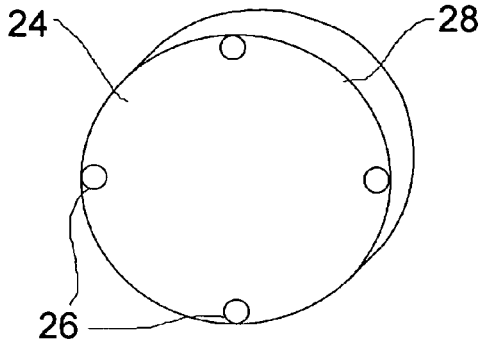
FIG. 6 is a perspective view of a carbide piece.
Figure 7:
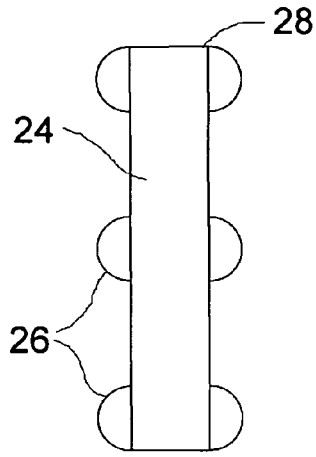
FIG. 7 is a side view in section of a carbide piece.
Figure 8:
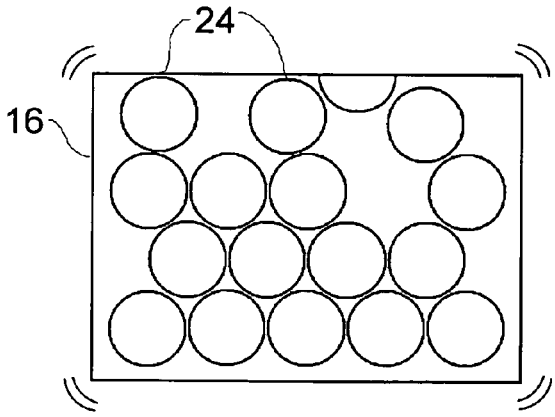
FIG. 8 is a front view in section of the carbide pieces in the insertion gap being shaken.
Figure 9:
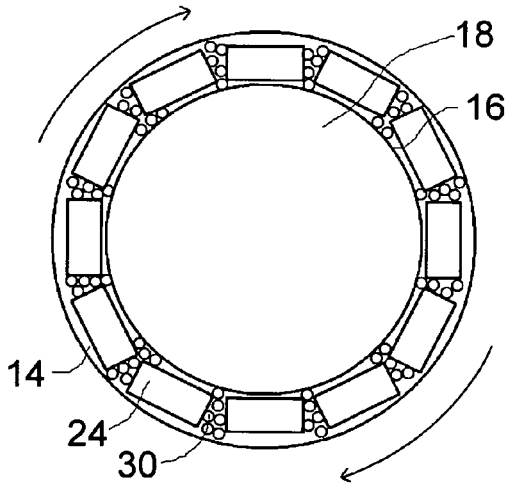
FIG. 9 is a top plan view in section of the carbide pieces and the bonding powder being positioned by centrifugal force.
Figure 10:
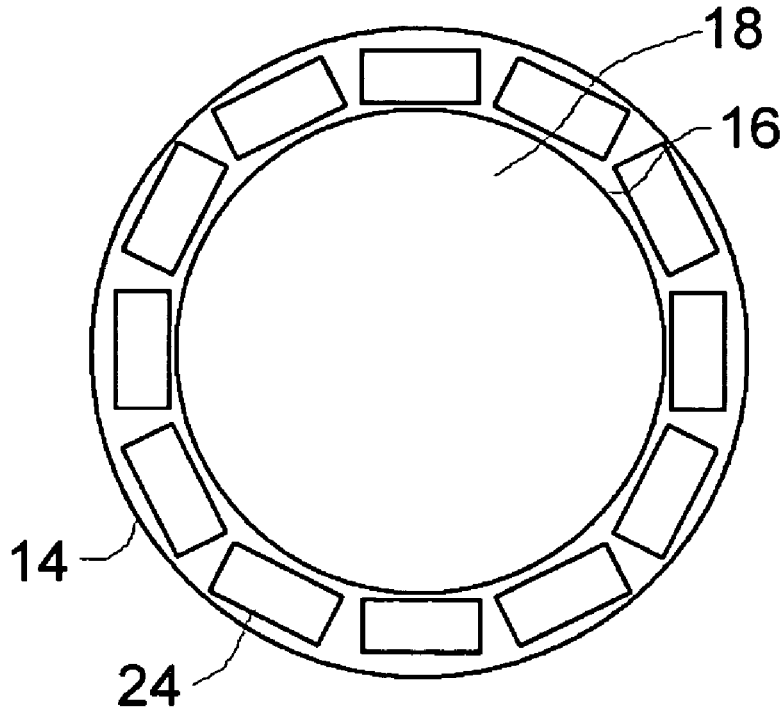
FIG. 10 is a top plan view in section of carbide pieces positioned in the insertion gap.
Figure 11:
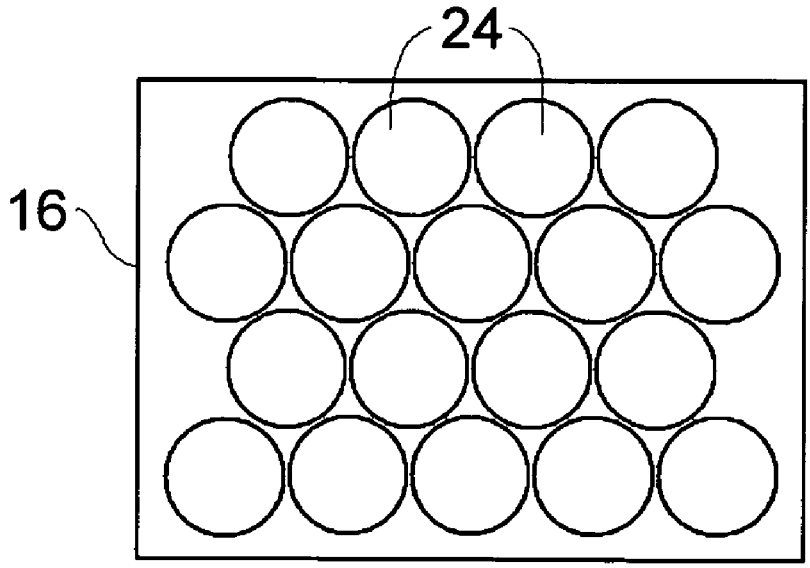
FIG. 11 is a front view in section of carbide pieces positioned in the insertion gap.
Figure 12:
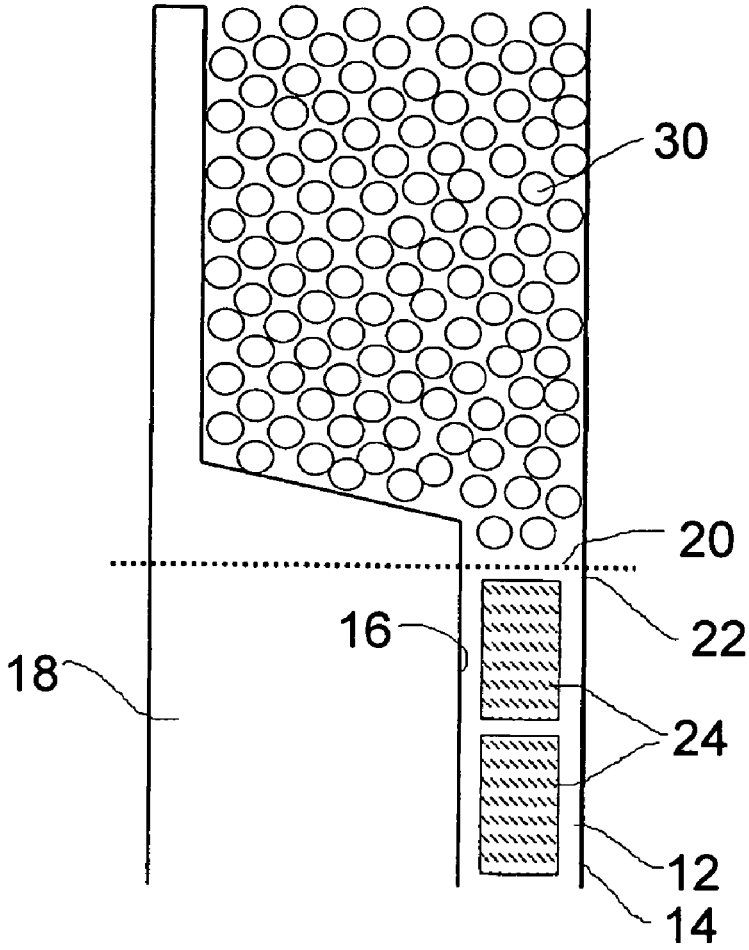
FIG. 12 is a side view in section of bonding powder being inserted into insertion gap.
Figure 13:
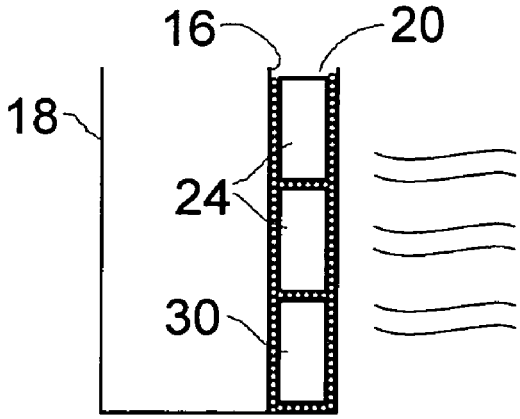
FIG. 13 is a side view in section of the bonding powder being heated.
Figure 14:
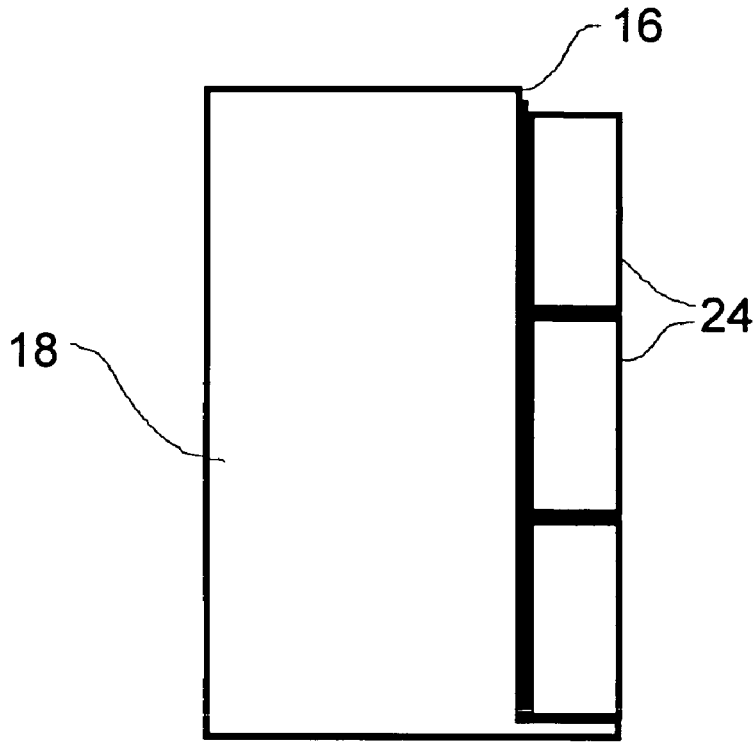
FIG. 14 is a side view in section of the surface to be hard coated with the sleeve removed.

Referring to FIG. 1, the process begins by securing a temporary membrane 12 in the form of a tubular sleeve 14 a pre-selected distance from a surface 16 of a tubular work piece 18 intended to be hard coated. This may be done by welding, represented by weld 19, for example. FIGS. 3 and 4 show alternate ways of attaching sleeve 14 to surface 16, depending on the shape of work piece 18. The result is an insertion gap 20 that is accessible from an upper end 22. Referring to FIG. 2, insertion gap 20 is then filled with carbide pieces 24 sized to fit into insertion gap 20 in a selected orientation. Referring to FIG. 6 a suitable form for carbide pieces 24 is in the form of a puck with a circular peripheral edge 28. Referring to FIG. 7, carbide pieces 24 may also have nubs 26 positioned on each side of carbide piece 24 spaced about peripheral edge 28. Insertion gap 20 is filled with carbide pieces 24 by inserting carbide pieces 24 from upper end 22 of insertion gap 20 and allowing them to drop into insertion gap 20 by force of gravity, as shown in FIG. 2. Referring to FIG. 8, optionally work piece 18 may be shaken, to promote a uniform distribution of carbide pieces 24 as shown in FIGS. 9 and 10, which orient themselves due to the relative engagement of their circular peripheral edges 28. Referring to FIG. 12, the spaces between carbide pieces 24 are filled with bonding powder 30 by inserting bonding powder 30 into upper end 22 of insertion gap 20. If nubs 26 are provided, a spacing is created that facilitates bonding powder 30 to fall between surface 16 and carbide pieces 24. Referring to FIG. 13, powder 30 is then heated until carbide pieces 24 are bonded to surface 10. Referring to FIG. 14 temporary membrane 12 is removed. For applications for which heat treatment is requested by the client, such heat treatment should be performed prior to removal of membrane 12.

Referring to FIG. 9, it may also be desired to subject work piece 18 to centrifugal force prior to and then concurrently with filling insertion gap 20 with bonding powder 30, to laterally align carbide pieces 24 in a consistent manner.

Advantages:

The method, as described above, provides a number of substantial advantages. Firstly, it enables carbide pucks to be secured to the surface of the work piece at a relatively rapid rate.

Secondly, the carbide "pucks" tend to be self aligning, so a lot of time need not be spent on orientation. To enhance orientation, one need only have the work piece shaken to ensure uniform positioning of the carbide pucks. Using this method the carbide coverage on the work piece has been successfully increased to approximately ninety percent, with a fraction of the labour previously required. Although tubular work pieces have been illustrated with annular insertion gaps, it must be appreciated that the same approach using a temporary sleeve may be taken with flat work pieces and work pieces of other shapes and configurations.

Figure 23:
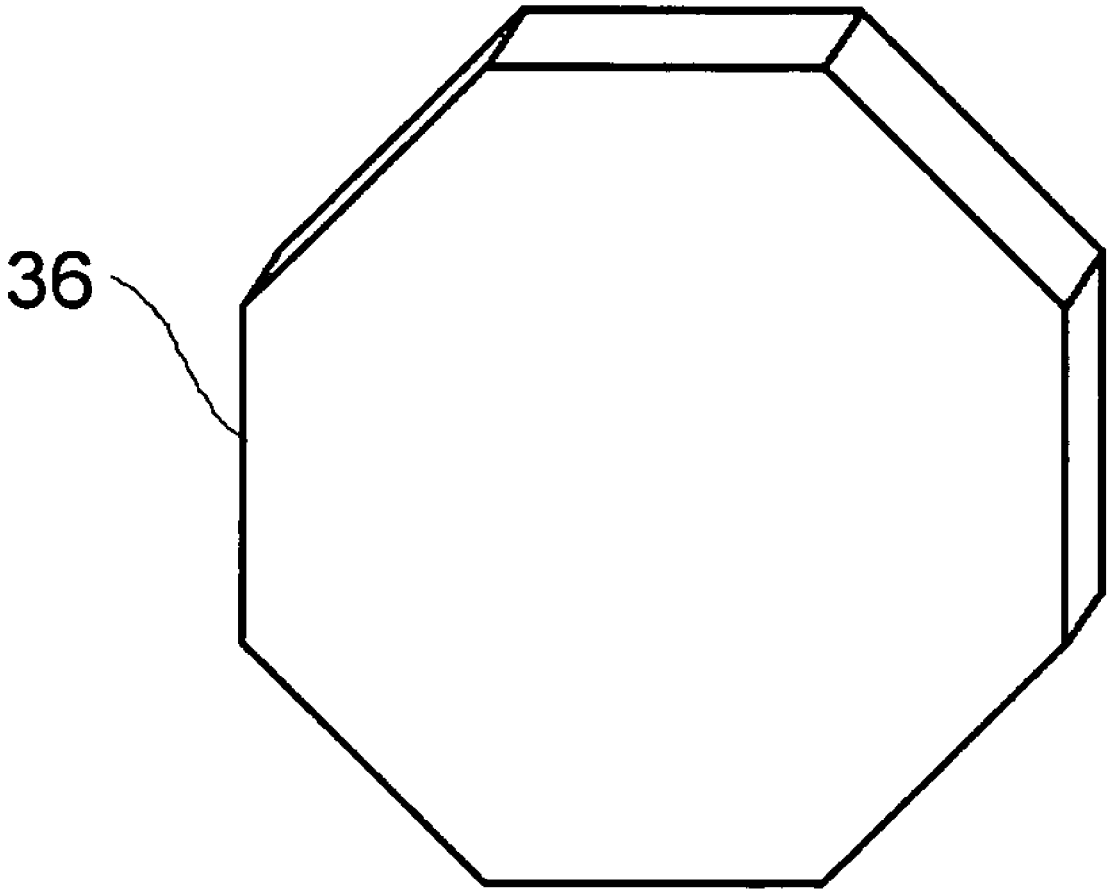
FIG. 23 is a perspective view of an octagonal carbide puck.

Variations in carbide "puck" configurations:

Carbide pieces 24 of any shape may be used. However, once one goes away from "pucks" orientation becomes more of a problem. This can be addressed by using multi-sided polygons (hexagons, octagons, etc), that will behave and orient themselves like "pucks" and can be considered an alternative form of "puck". This can be seen in FIG. 23, where carbide puck 36 has an octagon shape.

Figure 15:
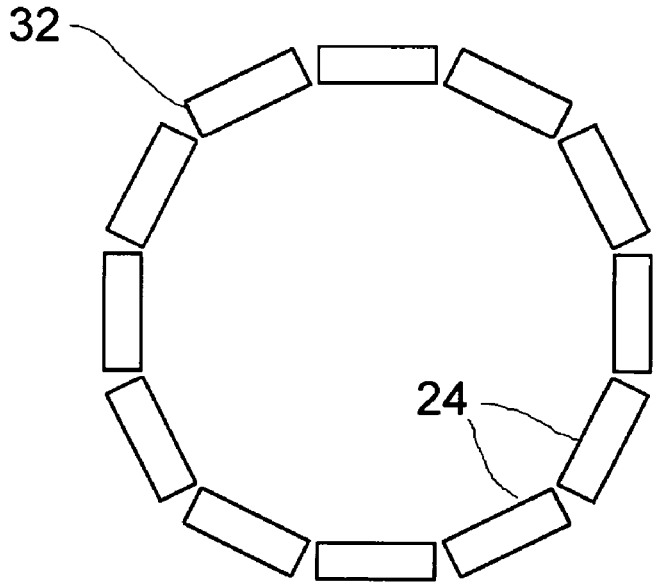
FIG. 15 is a top plan view of a ring or carbide pieces.
Figure 16:
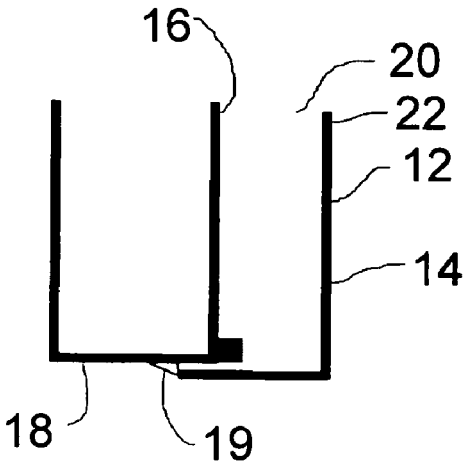
FIG. 16 is a side plan view in section of a sleeve secured to a surface to be hard coated forming an insertion gap.
Figure 17:
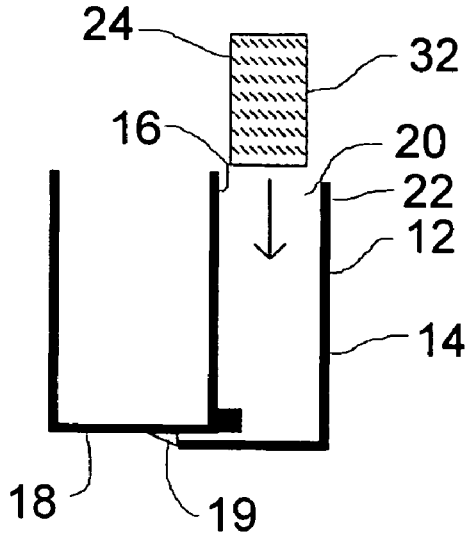
FIG. 17 is a side plan view in section of the insertion gap being filled with carbide pieces in a ring.
Figure 18:
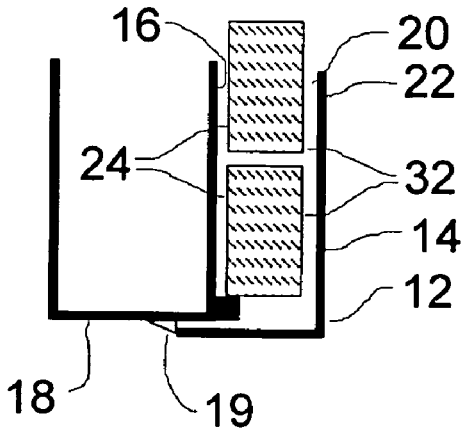
FIG. 18 is a side plan view of the insertion gap filled with carbide pieces in a ring.

Variations using carbide groupings:

Carbide pieces 24 in the form of "pucks", as described above, are preferred because they are capable of self orientation. However, there are other approaches that may be taken to the problem of orientation. One variation to the above described method, which is contemplated is the use of carbide groupings to ensure proper orientation. With this variation, carbide pieces 24 are formed into groupings in advance, in order to speed up insertion. For example, carbide pieces 24 may be formed into a ring. Referring to FIG. 15, there is illustrated carbide pieces 24 formed into a ring 32, which may then be dropped into insertion gap 20. The method may be seen by referring to FIGS. 16 through 18, where, referring to FIG. 16, temporary membrane 12 is positioned a pre-selected distance from surface 16 of work piece 18 to be hard coated to create an insertion gap 20. Referring to FIGS. 17 and 18, insertion gap 20 is filled by stacking a series of groupings of carbide pieces 24, such as rings 32 shown in FIG. 15, sized to fit insertion gap 20 in a selected orientation. The spaces between carbide pieces 24 may then be filled with a bonding agent 30, which can then be heated and temporary membrane 12 removed, as with the method described previously.

Figure 19:
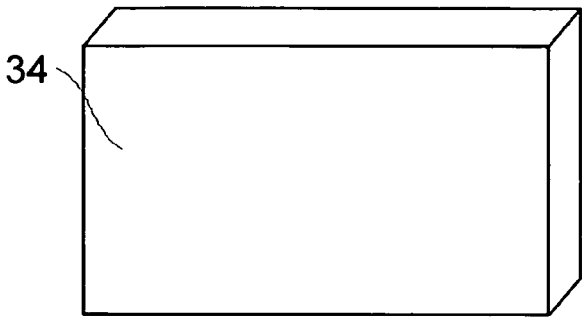
FIG. 19 is a perspective view of a rectangular carbide puck.

Variations using different shapes for carbide pieces:

As stated above, carbide pieces 24 of any shape may be used. However, orientation becomes more of a problem. To illustrate the point, the application of carbide pieces 34 that are rectangular has been illustrated in FIG. 19 and will now be described. With rectangular pieces there is a trade off which occurs. When rectangular pieces are used with this method, carbide coverage of the work piece can be further increased from 90% to an astounding 99%.

Figure 20:
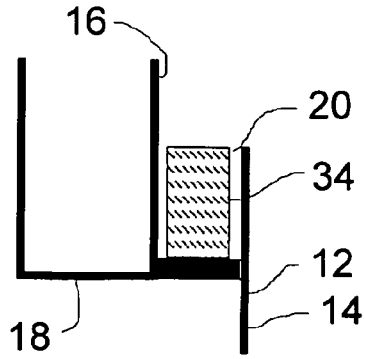
FIG. 20 is a side plan view in section of an insertion gap being filled with rectangular carbide pieces.
Figure 21:
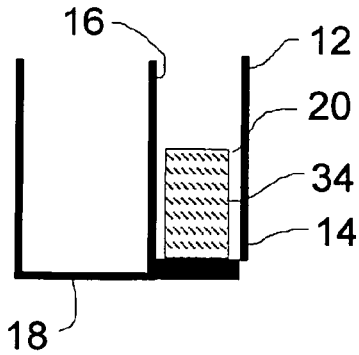
FIG. 21 is a side plan view in section of the insertion gap of FIG. 20 being enlarged.
Figure 22:
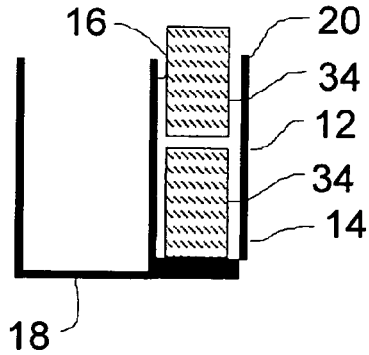
FIG. 22 is a side plan view of the enlarged insertion gap filled with carbide pieces.

However, greater care must be taken in placement of the rectangular carbide pieces, as they will not self-orientate in the same manner as circular pucks or multi-sided pucks. Referring to FIG. 20, to hard coat surface 16 with rectangular carbide pieces 34, temporary membrane 14 is positioned a pre-selected distance to create insertion gap 20 and insertion gap 20 is filled with a row of carbide pieces 34. Referring to FIG. 21, temporary membrane 14 is then slid along work piece 18 to increase the size of insertion gap 20. Referring to FIG. 22, insertion gap 20 is then filled with another row of carbide pieces 34 sized to fit insertion gap 20 in the selected orientation. Although for illustration purposes, only two rows are shown, the steps may be repeated to continue progressively increasing insertion gap 20 and filling insertion gap 20 with carbide pieces 34. Once surface 16 is satisfactorily covered, the method continues as described previously.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of hard coating a surface with carbide, comprising the steps of:

providing identical circular carbide pucks having a diameter and a height, the diameter being greater than the height;

positioning a temporary membrane a pre-selected distance from a surface of a work piece to be hard coated to create an insertion gap that is smaller than the diameter of the carbide pucks and just large enough to receive the carbide pucks placed on edge;

filling the insertion gap with the carbide pucks placed on edge;

filling spaces between the carbide pucks with a bonding agent by inserting the bonding agent into an upper end of the insertion gap;

heating the bonding agent until the carbide pucks are bonded to the surface; and removing the temporary membrane.

2. The method as defined in claim 1, the bonding agent being a powder.

3. The method as defined in claim 1, the work piece being tubular and the temporary membrane being a sleeve.

4. The method as defined in claim 1, including a step of filling the insertion gap with carbide pucks by inserting them from the upper end into the insertion gap and allowing them to drop by force of gravity.

5. The method as defined in claim 4, including a step of shaking the work piece concurrently with the step of filling the insertion gap with carbide pucks, thereby promoting a uniform distribution of the carbide pucks.

6. The method as defined in claim 1, including a step of subjecting the work piece to centrifugal force prior to and then concurrently with the step of filling the insertion gap with the bonding agent.

7. A method of hard coating a surface with carbide, comprising the steps of:

providing identical carbide pucks having a multisided peripheral edge, a diameter and a height that is less than the diameter;

securing a temporary membrane in the form of a tubular sleeve a pre-selected distance from a surface of a tubular work piece to be hard coated to create an insertion gap which is accessible from an upper end that is smaller than the diameter of the carbide pucks and just large enough to receive the carbide pucks on edge;

filling the insertion gap by inserting the carbide pucks on edge from the upper end of the insertion gap and allowing them to drop into the insertion gap by force of gravity;

shaking the work piece thereby promoting a uniform distribution of the carbide pucks, which orient themselves due to the relative engagement of their multisided peripheral edges;

filling spaces between the carbide pucks with bonding powder by inserting the bonding powder into the upper end of the insertion gap;

heating the powder until the carbide pucks are bonded to the surface; and removing the temporary membrane.

8. The method as defined in claim 1, including a step of subjecting the work piece to centrifugal force prior to and then concurrently with the step of filling the insertion gap with bonding powder, to laterally align the carbide pucks in a consistent manner.

9. The method as defined in claim 1, including a step of heat treating prior to removing the temporary membrane.

10. The method of claim 1, further comprising the step of securing carbide pieces together into preformed groupings of carbide pieces prior to filling the insertion gap with carbide pieces.

11. The method as defined in claim 10, wherein the groupings of carbide pieces are rings.

12. A method of hard coating a surface with carbide, comprising the steps of:

providing identical carbide pucks having a peripheral edge, opposed faces, spacing nubs projecting from the opposed faces, a diameter and a height that is less than the diameter;

positioning a temporary membrane a pre-selected distance from a surface of a work piece to be hard coated to create a insertion gap that is smaller than the diameter to receive the carbide pucks positioned on edge;

filling the insertion gap with the carbide pucks placed on edge and having their spacing nubs engaging the surface of the work piece and the temporary membrane;

filling spaces between the carbide pucks with a bonding agent by inserting the bonding agent into an upper end of the insertion gap;

heating the bonding agent until the carbide pucks are bonded to the surface; and removing the temporary membrane.

* * * * *